US007788074B2

(12) United States Patent
Scheidt et al.

(10) Patent No.: US 7,788,074 B2
(45) Date of Patent: Aug. 31, 2010

(54) METHOD OF MODELLING THE PRODUCTION OF AN OIL RESERVOIR

(75) Inventors: Céline Scheidt, Rueil Malmaison (FR); Isabelle Zabalza-Mezghani, Rueil Malmaison (FR); Dominique Collombier, Nancy (FR); Mathieu Feraille, Nanterre (FR)

(73) Assignee: Institut Francais du Petrole, Rueil-Malmaison Cedex (FR)

( * ) Notice: Subject to any disclaimer, the term of this patent is extended or adjusted under 35 U.S.C. 154(b) by 619 days.

(21) Appl. No.: 11/207,902

(22) Filed: Aug. 22, 2005

(65) Prior Publication Data

US 2006/0047489 A1 Mar. 2, 2006

(30) Foreign Application Priority Data

Aug. 30, 2004 (FR) ..... 04 09177

(51) Int. Cl.
*G06G 7/48* (2006.01)

(52) U.S. Cl. ..... 703/10

(58) Field of Classification Search ..... 703/10
See application file for complete search history.

(56) References Cited

U.S. PATENT DOCUMENTS 4,969,130 A 11/1990 Wason et al.
5,889,729 A 3/1999 Frenkel et al.
5,992,519 A 11/1999 Ramakrishnan et al.

FOREIGN PATENT DOCUMENTS

EP 1 441 238 A2 7/2004
WO WO 00/48022 8/2000

OTHER PUBLICATIONS

Ewing et al. "Estimating Parameters in Scientific Computation". 1994 IEEE.*
Catherine Bogan et al., "Building Reservoir Models Based on 4D Seismic & Well Data In Gulf of Mexico Oil Fields", SPE 84370, Oct. 5, 2003, pp. 1-11, XP002323905.

* cited by examiner

*Primary Examiner*—Kamini S Shah
*Assistant Examiner*—Saif A Alhija
(74) *Attorney, Agent, or Firm*—Antonelli, Terry, Stout & Kraus, LLP.

(57) ABSTRACT

The invention stimulates production of an oil reservoir by determining a flow simulator from physical data measured in the oil reservoir; determining a first analytical model relating the production of the reservoir as a function of time by accounting for parameters which provides adjustment to production values closest to the production of the reservoir, the first model providing adjustment to the production values closest to a production values provided from the flow simulator; selecting at least one new production value, which is obtained from the reservoir simulator; and determining a second model by adjusting the first model so that the second model interpolates the new production value.

28 Claims, 2 Drawing Sheets

METHOD OF MODELLING THE PRODUCTION OF AN OIL RESERVOIR

BACKGROUND OF THE INVENTION

1. Field of the Invention

The present invention relates to the study and to the optimization of oil reservoir production schemes and models of production behavior of an oil reservoir in order to compare production schemes and to define an optimum scheme considering a given production criterion such as oil recovery, water inflow, production rate, etc.

2. Description of the Prior Art

The study of a reservoir comprises two main stages.

The reservoir characterization stage determines a numerical flow model or flow simulator that is compatible with the real data collected in the field. Engineers have access to only a small part of the reservoir under study (core analysis, logging, well tests) and have to extrapolate these limited data over the entire oilfield to construct the numerical simulation model.

The production prediction stage uses the numerical simulation model to estimate the reserves and production to be obtained in the future or to improve the production scheme in place. This stage is carried out using a numerical simulation model constructed from many data sources, obtained from only a small part of the reservoir. Consequently, an uncertainty notion has to be constantly accounted for in this stage.

In order to properly characterize the impact of each uncertainty on the oil production, the largest possible number of production scenarios has to be tested, which therefore requires a large number of reservoir simulations. Considering the long time required for a flow simulation, it is clearly not conceivable to test all possible scenarios via the numerical flow model. In this context, using the experimental design method can allow construction of a simplified model of the flow simulator as a function of a reduced number of parameters. Experimental designs allow determination of the number and the location in space of the parameters of the simulations to be carried out so as to have a maximum amount of pertinent data at the lowest possible cost. This simple model translates the behavior of a given response (for example the 10-year cumulative oil production) as a function of some parameters. Its construction requires a reduced number of simulations previously defined by experimental designs.

During the production prediction stage, the simplified model is used because it is simple and analytical and, therefore, each simulation obtained by this model is immediate. This saves considerable time. Using this model allows the reservoir engineer to test as many scenarios as are wanted, without having to care about the time required to perform a numerical flow simulation.

The methods disclosed in French patents 2,855,631 and 2,855,633 use simplified models to optimize the production of an oil reservoir or as decision support for managing an oil reservoir, in the presence of uncertainties.

The simplified model obtained using experimental designs implies that the response obtained by the model is a linear function of the parameters taken into account. However, in most cases, this is not true. When the range of evolution of a parameter(s) (permeability, porosity, . . . ) is relatively limited and its contribution is reasonable, its behavior can be assumed to be linear. But when this range of evolution of the parameter (s) becomes too large or when the contribution of the parameter is no longer linear, the linearity hypothesis biases the knowledge of the oil reservoir.

It is therefore necessary to set a criterion allowing detection of non-linearities and to establish an efficient and fast methodology allowing prediction, in an effective manner, of non-linear response behaviors.

SUMMARY OF THE INVENTION

The present invention models an oil reservoir by iterative adjustments so as to best reproduce the behavior of the oil reservoir, while controlling the number of simulations.

In general terms, the present invention relates to a method for simulating production of an oil reservoir wherein the following stages are carried out:

a) providing a flow simulator utilizing physical data obtained from measurements in the oil reservoir;

b) determining a first analytical model representing the production of the reservoir as a function of time by accounting for parameters which influence production of the reservoir, which provides adjustment to production values provided by the flow simulator;

c) selecting at least one new production value associated with a point within an area of the reservoir selected as a function of non-linearity of production in the area of the reservoir with the new value being obtained from the flow simulator; and d) determining a second model by adjusting the first model so that a response of the second model at the point corresponding to the new production value.

According to the invention, in c), the following steps can be carried out:

determining a sub-model that optimally adjusts to production values, except for a test value selected from among the production values;

calculating a prediction residue associated with the test value by determining a difference between a response of the sub-model and the test value;

calculating the prediction residue associated with each production value by repeating determining a sub-model and calculating a prediction residue associated with the test value by assigning successively to the test value each value of the production values; and selecting the new production value in another area of the reservoir in a vicinity of the point with the new production value having a greatest prediction residue.

The new production value can be selected accounting for a gradient of production at a point associated with the production value having the greatest prediction residue.

Furthermore, a new value can be selected in c) and d) can be carried out provided that the greatest prediction residue is greater than a previously set value.

According to a variant of the invention, in step c), the following steps can be carried out:

determining a first kriging variance of the first model for the production values obtained from the flow simulator;

selecting a first pilot point in the reservoir at a location where the first kriging variance is maximum;

determining a second kriging variance of the first model for the production values obtained from the flow simulator and the first pilot point;

selecting a second pilot point in the reservoir at a location where the second kriging variance is maximum; and assigning a value to each pilot point by carrying out the following steps for each pilot point:

determining a sub-model that adjusts the production values and to a value associated with one of the pilot points, except for a test value selected from among production values and the value associated with the one pilot point;

calculating a prediction residue associated with the test value determining the difference between a response of the sub-model and the test value;

calculating the prediction residue associated with each sub-model response by repeating determining the sub-model and calculating the prediction residue by assigning successively to the test value each value contained in a set of production values and a value associated with the one pilot point;

calculating a sum of absolute values of the prediction residues calculated for each test value;

assigning to the one pilot point a value that minimizes this sum;

determining a second sub-model that adjusts to the production values and values of the pilot points;

for each pilot point, determining a difference between a response of the second sub-model and a response of the first model; and associating the new production value of step c) with the pilot point for which the difference is the greatest.

Furthermore, in d), the second model can be determined by adjusting the first model so that the response of the second model at the pilot point selected corresponds to the new production value and, furthermore, to the values assigned to other pilot points.

According to another variant of the invention, in c), the following steps can be carried out:

determining an analytical model expressing a derivative of the reservoir production as a function of time, the model adjusting to derivatives at points associated with the production values used in b); and from the model expressing the derivative, selecting at least one new production value associated with a point whose response of the model expressing the derivative is zero.

It is possible to select a new value in c) and d) can be carried out, provided that the prediction residue of the new selected value is greater than a previously set value.

According to the invention, after d), the following steps are carried out:

determining a third analytical model expressing the derivative of the reservoir production as a function of time, the third model adjusting to the derivatives at the points associated with the production values and the production values selected in c);

if the response of the third analytical model at the point selected in c) is greater than zero, determining a point associated with the maximum value of the response of the second model in a vicinity of the point selected in c);

if the response of the third analytical model at the point selected in c) is less than zero, determining a point associated with a minimum value of the response of the second model in a vicinity of the point selected in c), determining a new production value using the flow simulator at a point associated with a previously determined minimum or maximum value;

determining a fourth model by adjusting the second model so that the response of the fourth model corresponds to a new value determined in the determining a new production value using the flow simulator.

According to the invention, c) and d) can be repeated.

In b), the production values can be selected using an experimental design.

In b), the first model can be adjusted using one of the following approximation methods: polynomial approximation, neural networks or support vector machines.

In d), one of the following interpolation methods can be used: kriging or spline methods.

Thus, the method according to the invention provides the reservoir engineer with a simple and inexpensive form of numerical simulation for scenario management and production scheme optimization, as a support for decision-making for minimizing risks.

BRIEF DESCRIPTION OF THE DRAWINGS

Other features and advantages of the invention will be clear from reading the description hereafter, with reference to the accompanying figures wherein.

DETAILED DESCRIPTION OF THE INVENTION

Figure 1:
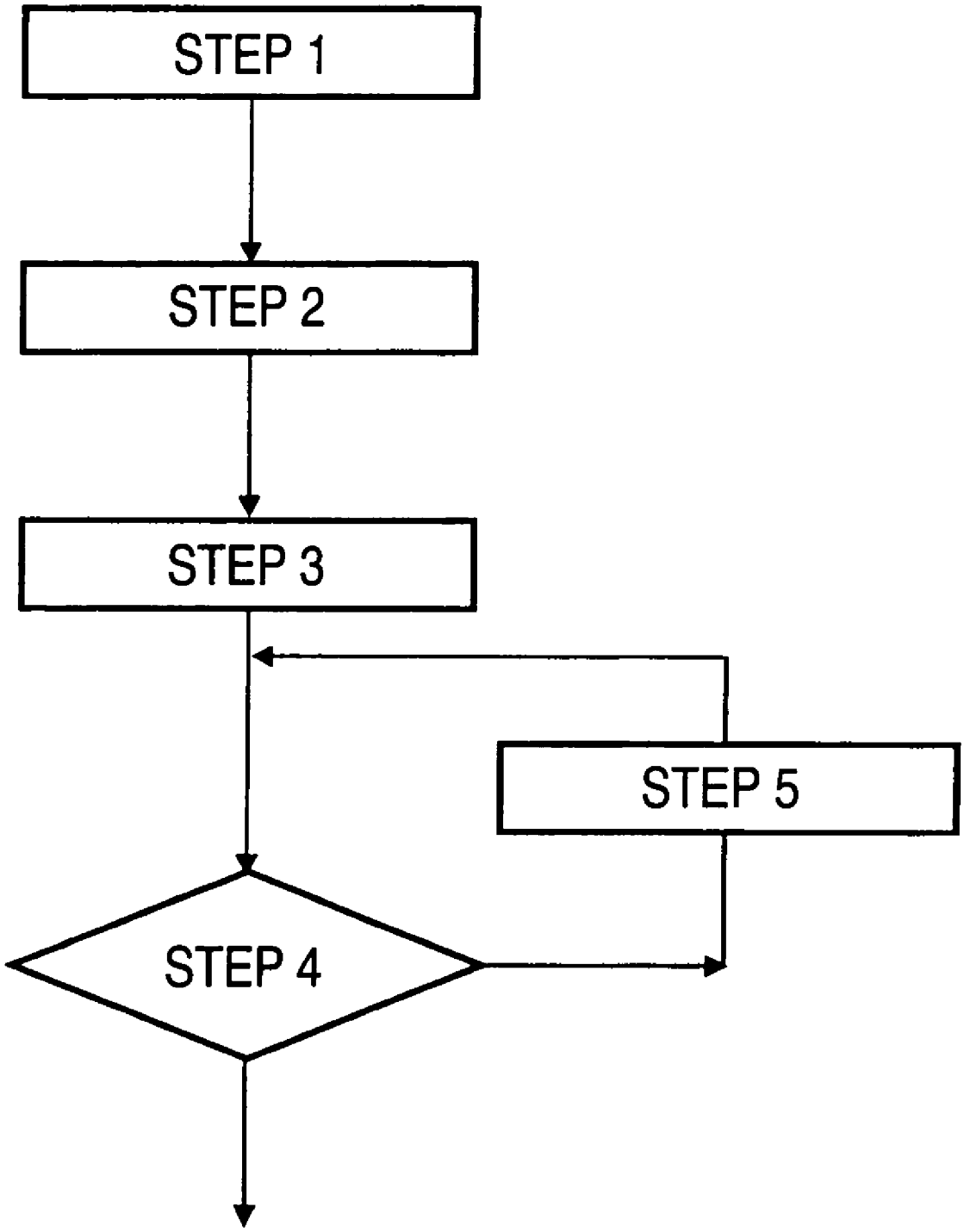
FIG. 1 diagrammatically shows the method according to the invention.

The method according to the invention is illustrated by the diagram of FIG. 1.

Step 1: Providing a Reservoir Flow Simulator

The oil reservoir is modelled using a numerical reservoir simulator. The reservoir simulator or flow simulator notably allows calculation of production of hydrocarbons or of water in time as a function of technical parameters such as a number of layers in the reservoir, permeability of the layers, aquifer force, position of oil wells, etc. Furthermore, the flow simulator calculates the derivative of the production value at the point which is considered.

The numerical simulator is provided using characteristic data of the oil reservoir. For example, the data are obtained by measurements performed in the laboratory on cores and fluids taken from the oil reservoir, by logging, well tests, etc.

Step 2: Approximation of the Flow Simulator

Since the flow simulator is complex and calculation time is consuming, a simplified model of the behavior of the oil reservoir is constructed.

Parameters having an influence on the hydrocarbon or water production profiles of the reservoir are selected. Selection of the parameters can be done either through physical knowledge of the oil reservoir, or by means of a sensitivity analysis. For example, it is possible to use a statistical Student or Fischer test.

Some parameters can be intrinsic to the oil reservoir. For example, the following parameters can be considered: a permeability multiplier for particular reservoir layers, aquifer force of residual oil saturation after waterflooding.

Some parameters can correspond to reservoir development options. These parameters can be well position, completion level or drilling technique.

Points for which the numerical flow simulations will be performed are selected from the experimental domain. These points are used to provide a simplified model that best reproduces the reservoir flow simulator. These points are selected using an experimental design method, which allows determination of the number and the location of the simulations to be carried out so as to have a maximum amount of information at the lowest possible cost, and thus to determine a reliable model best representing the production profile. It can be noted that selection of the experimental design method is very important: the initial experimental design method plays an essential part in determination of the modelling of the first model, and the results greatly depend on a pattern of experimentation.

Selection of the simulation points is determined using experimental designs, for example factorial designs, composite designs, Latin hypercubes, maximum distance designs, etc. It is possible to use the experimental designs described in the following documents:

1. Dejean, J. P. and Blanc, G., "Managing Uncertainties on Production Predictions Using Integrated Statistical Methods", SPE 56696, SPE Annual Technical Conference and Exhibition, Houston, USA, Oct. 3-6, 1999.

2. Box, G. E. P. and Hunter, J. S., "The 2k-p Fractional Factorial Designs", Part I, Technometrics, 2, 311-352, 1961a 3. Box, G. E. P. and Hunter, J. S., "The 2k-p Fractional Factorial Designs", Part II, Technometrics, 3, 449-458, 1961b 4. Box, G. E. P and Wilson, K. B., "On the Experimental Attainment of Optimum Conditions", Journal of the Royal Statistical Society, Series B, 13, 1-45

5. Draper, N. R., "Small Composite Designs", Technometrics, 27, 173-180, 1985

6. Atkinson, A. C. and Donev, A. N., "Optimum Experimental Designs", Oxford University press, 1992.

After determination of a first experimental design and when the numerical simulations are performed, an approximation method is used to provide a first model representing a trend of behaviour of the response function, that is which approximates a flow simulator.

The first model expresses a production criterion studied over the course of time. The production criterion is expressed as a function of the selected parameters. The production criterion can be for oil recovery, water inflow or a rate of production. The first analytical model is determined using previously selected values of the production criterion obtained from the flow simulator.

When referring to approximation methods, consideration is given to polynomials of the first or second order, neural networks, support vector machines or possibly polynomials of an order greater than two. Selection of this model depends on one hand on a maximum number of simulations that can be utilized by the user and, on the other hand, on the initial experimental design that is used.

Step 3: Adjustment of the First Model

There may be a difference between the production value given by the first analytical model obtained in step 2 and the simulated production values used to provide the first model.

In this case, the residues are determined at the various simulation points. The residues correspond to the difference between a response of the first model and the value obtained by the reservoir flow simulator. Then, the residues are interpolated. Any n-dimensional interpolation method is suitable. The kriging or the spline method can be used in particular. These methods are explained in the book entitled "Statistics for Spatial Data" by Cressie, N., Wiley, New York 1991.

The residue interpolation structure lends itself well to this sequential approach because it is divided up into two parts: a linear model, which corresponds to the first model determined in step 2, and a "correcting" term allowing making up the difference between the prediction of the first model and the simulation point. In cases where the analytical model should be satisfactory, it is not necessary to add this "correcting" term. In the opposite case, it allows interpolation of the responses and, thus, accounting for non-linearities detected at the surface.

An adjusted second model is thus provided by adding the results of the interpolations of the residues to the first model determined in step 2.

Step 4: Model Predictivity Test and Selection of Additional Simulation Points

At this step of the modelling procedure, the second model interpolates exactly the simulations, therefore adjustment of the response function is optimum. Considering that the interpolation method is exact, the "conventional" residues are zero. Therefore, according to the invention, an interest is taken in the prediction residues. Therefore, the predictivity of the model is examined for the points outside the experimental design. The predictions have to be as accurate as possible. Consequently, a model predictivity test is carried out to evaluate the approximation quality so as to judge whether an improvement is necessary by addition of new points to the initial design.

Two criteria are involved in the predictivity test:

(1) a priori predictivity calculation with prediction residues calculation (2) a posteriori predictivity calculation with use of confirmation points.

A Priori Predictivity

The prediction residues are the residues obtained at a point of the design by carrying out adjustment of the first model without this point. Removing a point and re-estimating the model will allow determination of whether this point (or the zone of the design close to this point) provides decisive information or not. Calculation of these prediction residues is carried out for each point of the initial experimental design. In the vicinity of the points considered the least predictive of the current design, that is the points having the greatest prediction residue, new points are simulated. A sub-sampling zone is therefore defined in the vicinity of the points. Addition of these points can be conditioned by the fact that the residues are greater than a value set by the user.

The size of this sub-sampling zone can be defined using the information on the gradients of the production at the points and/or the value of the prediction residues. In fact, a high gradient value expresses a high variation of the response. It can therefore be informative to add a new point close to the existing one. On the other hand, a low gradient value in a given direction shows that there are no irregularities in this direction. It is therefore not necessary to investigate a wide variation range in this direction. To the contrary, the variation range for one of the parameters is all the wider as the value of the gradient is high in this direction. This approach allows elimination of certain directions (where the value of the gradient is not significant) and thus to reduce the number of simulations to be performed. This sub-sampling can for example result from the construction of a new experimental design defined in this zone. Selection of this experimental design (factorial design, composite design or Latin hypercube) results from the necessary compromise between the modelling cost and quality.

Alternatively, the pilot point method can be used to improve the second model.

For a given number of experimentations, there is a large number of estimators (exact interpolators) going through all the experimentations and respecting the spatial structure (expectation and covariance) of the process. In this class of estimators regarding the data, the estimation is sought that maximizes the a priori predictivity. In order to go through this class of estimators, fictitious information is added, that is, pilot points are added to the simulated experimentations. These pilot points are then considered to be data although no simulation has been carried out and allow going through all the estimators passing through all the experimentations. The goal is to select the interpolator that maximizes the a priori predictivity coefficient of the model, that is, the pilot points are positioned so as to obtain the maximum predictivity realization.

The location of a pilot point is determined by accounting for the following two criteria:

(1) the capacity of the pilot point to reduce the difference between the observations and the results of numerical flow simulations; and (2) the contribution of the pilot point to the reduction of the uncertainties on the current approximation model.

For this selection to be made in an optimum way, the impact of a possible pilot point on each one of these two criteria has to be quantified.

In order to remove the prediction uncertainty regarding places which have small representation, it is interesting to apply local perturbations to the zones with a high kriging variance (absence of observations). A pilot point is thus placed where the kriging variance is maximum. Methods for determining the kriging variance are described in the book entitled "Statistics for Spatial Data" by Cressie, N., Wiley, New York 1991.

The following operations are carried out to determine the location of a pilot point:

determining the kriging variance in the uncertain domain of the second model determined in step 3 for the finite number of production values obtained by the flow simulator, placing a first pilot point where the kriging variance is maximum.

It is assumed that, besides the production values obtained by the flow simulator, a certain number of pilot points has already been positioned in the uncertain domain and new pilot points are to be positioned to improve the model predictivity. The existing pilot points are then considered as local data of zero variance. By taking account of the location of already existing points, optimizing of the location of the pilot points sequentially occurs.

Thus, to determine the location of a second pilot point, the following operations are carried out:

(1) determining the kriging variance of the first model for the finite number of production values obtained by the flow simulator and the first pilot point;

(2) determining the location of a second pilot point where the kriging variance is maximum.

Several pilot points can be added by repeating the previous two operations.

It is preferable to add a number of pilot points that is less than or equal to the number of real experiments so as not to perturb the model. Once the optimum location of the pilot points is determined, a "fictitious" response value has to be assigned at these points.

Since the goal of the addition of pilot points is to improve the a priori predictivity of the model, the value of the pilot points have to be defined from an objective function that measures this predictivity. Since kriging is an exact interpolation method, the "conventional" residues are zero. These residues therefore provide no information on the predictivity and consequently the prediction residues are considered. What is referred to as a priori predictivity is the calculation of the prediction residues at each point of the initial experimental design. The prediction residues are the residues obtained at a point of the initial experimental design by adjusting the first model without this point.

The following steps can be carried out to determine the production value associated with one of the pilot points whose location has been previously determined:

(a) determining a sub-model that adjusts to a finite number of production values and to a value associated with the pilot point, except for a test value selected from among the finite number of production values and the value associated with the pilot point;

(b) calculating a prediction residue associated with the test value by determining a difference between the sub-model response and the test value;

(c) calculating the prediction residue associated with each response of the prediction sub-model by repeating (a) and (b) by assigning successively to the test value each one of the values contained in the finite number of production values and the value associated with the pilot point;

(d) calculating a sum of the absolute values or of squares of the prediction residues determined for each test value; and (e) assigning to the pilot point a value that minimizes this sum.

Removing a point and re-estimating the model allows determination of whether this point or the zone of the experimental domain close to this point provides decisive information or does not. Calculation of the prediction residues is carried out in a vicinity of the pilot point to be optimized. Initial values for the pilot points are set, then these data are considered as real and the value of the pilot point is varied to obtain a model that is as predictive as possible, that is, it is desired to minimize the mean prediction error of the model.

Determination of the optimum value of the pilot point is thus performed to minimize a mean prediction error of the model throughout the uncertain domain. Similarly, this determination of the optimum value of the pilot point can be carried out so as to minimize local prediction error of the model (that is in a vicinity of the pilot point, regardless of the other prediction errors).

Once the value and the position of the pilot points are determined, testing of the sensitivity of the model occurs at the new points which have been added and then simulations are carried out at the points that are very sensitive to change in the approximation. The estimator obtained without pilot points is compared with the estimator obtained by kriging with pilot points (that is the maximum predictivity realization).

The points exhibiting the greatest disagreement, that is with the greatest difference, translate to a high approximation instability. Consequently, it is essential to improve the approximation quality in these places. Thus, the simulations corresponding to the points with the greatest disagreement are carried out in order to stabilize the approximation.

In order to select the pilot points for which a simulation will be carried out, the following stages can be carried out:

determining a sub-model from the pilot points and the finite number of production values; and for each pilot point, calculating a difference between the response of this sub-model and the response of the second model determined in step 3, According to a first variant:

Selecting the pilot point for which the difference between the response of the sub-model and the response of the second model is the greatest. It is the point selected for improving the first model, the other pilot points are then ignored in the rest of the procedure.

According to a second variant:

Selecting one or more pilot points for which the predictivity is the poorest (less than a threshold below 1) since this low predictivity expresses a high sensitivity of the point. In the rest of the procedure, it is taken into account, on the one hand, the production values associated with the selected pilot points with production values being obtained by the flow simulator, and, on the other hand, the production values associated with the other pilot points whose predictivity is better with production values corresponding to the values estimated according to the aforementioned a priori predictivity.

According to the second variant, if the procedure is repeated, the local predictivity at non-simulated pilot points then has to be evaluated again to ensure that this value still corresponds to a satisfactory stabilization. If this is not the case, the non-simulated pilot point is no longer considered in the new estimation.

Addition of these new simulations then allows the residues to be studied. What is referred to as residues here is, for each pilot point, the difference between the simulated value and the value obtained upon optimization of the pilot points.

As before, if the residues are too great, there is a disagreement between the current approximation with the pilot points and the simulations; this expresses a predictivity defect of the model. In this case, the current model has to be improved, which again requires new simulations. One or more new iterations therefore have to be carried out.

On the other hand, if the residues are small, the prediction at these points is good and therefore the model seems to be predictive in the considered domains. The global predictivity of the model however needs to be confirmed by adding confirmation points. These new simulations allow determination of whether the iteration procedure has to be continued or not.

A Posteriori Predictivity

It is possible to add confirmation points, which are production values obtained by the flow simulator determined in step 1, to the experimental design by examining the derivative of the production values. In fact, a simulation addition criterion can be based on: (1) the value of the derivative of the production values obtained by the flow simulator, (2) direct identification of points whose production value is maximum or (3) direct identification of points whose production value is minimum.

A model is determined that approaches the values of the derivatives at the points selected by the experimental design in step 2. Then, a new simulation point is added in the place where the response of the derivative model is zero, provided that this point is sufficiently distant from the simulations already performed. These confirmation points allow testing of the predictivity of the second model, in this new investigated zone. If the prediction residues calculated at the new selected points exceed a value set by the user, these new points are used to carry out a new interpolation step.

Adding simulations to the current model, whether it is the consequence of a lack of a priori or a posteriori predictivity, allows increasing the quality and the quantity of information on the response function so as to obtain a more representative sampling.

Step 5: Construction and Adjustment of a Third Model

From the second model determined in step 2, the residues are determined at the new simulation points selected in step 4. The residues correspond to the difference between the response of the first model and the simulation value obtained by the reservoir flow simulator. The residues are then interpolated. Any n-dimensional interpolation method is suitable. For example, kriging or the spline method can be used.

The residue interpolation structure is divided up into two parts: the first model determined in step 2, and a "correcting" term allowing making up the difference between the prediction of the first model and the new simulation(s) selected in step 4. The new simulation allows interpolation of the responses and, thus, to account for the non-linearities detected at the surface.

An adjusted second model is determined by adding the results of the interpolation of the residues to the first model determined in step 2.

Iteration

It is furthermore possible, according to the invention, to improve the model iteratively by repeating steps 4 and 5.

In this case, during the new step 4, simulations points are added in relation to the model determined during the previous step 5. During the new step 5, a new model is constructed and adjusted starting from the simulation points selected in the new step 4 and by adjusting the first model determined in step 2.

Step 6: Seeking Inflection Points

If the a posteriori method has been used in step 4, the model determined in step 5 can be improved by adding simulation points by carrying out the following steps:

(a) determining an analytical model expressing the derivative of reservoir production as a function of time, by adjusting to the derivatives at the points associated with the production values selected in steps 2 and 4;

(b) checking that, at the point added in step 4, the response of the analytical model expressing the reservoir production derivative is zero;

if this response is greater than 0, determining the maximum of the third model determined in step 5 in the vicinity of the point added in step 4;

if this response is less than 0, determining the minimum of the third model determined in step 5 in the vicinity of the point added in step 4, (c) determining the value of the minimum or of the maximum by the flow simulator; and (d) determining a new model by adjusting the third model so that the response of the new model corresponds to the new minimum or maximum value obtained by the flow simulator.

Figure 2:
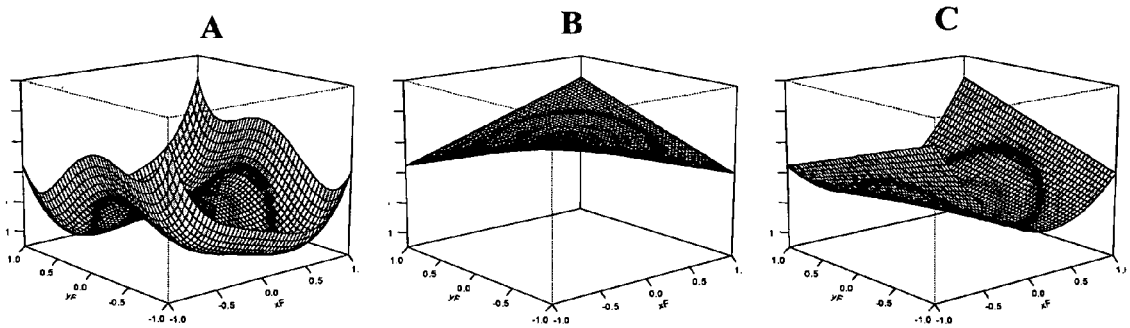
FIG. 2 diagrammatically shows a "camel" function and the approximation to this function by models obtained through experimental designs.
Figure 3:
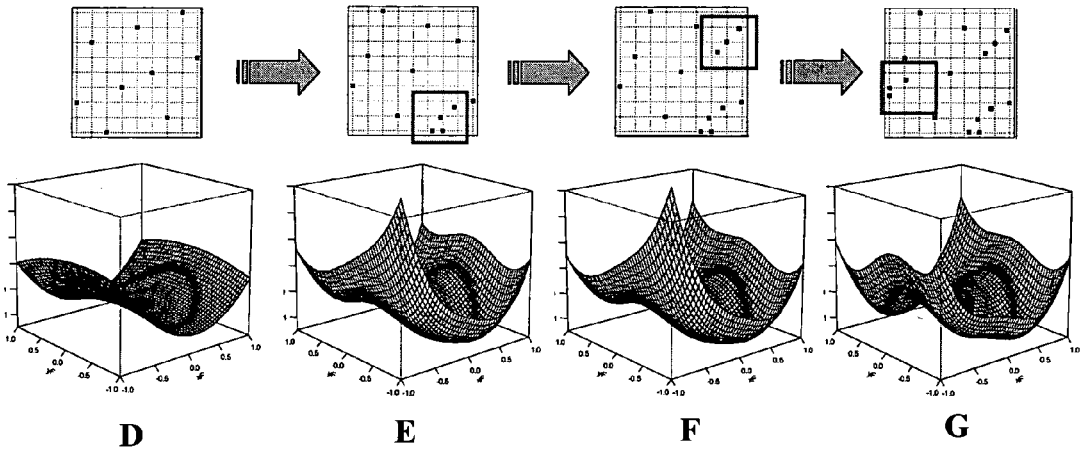
FIG. 3 diagrammatically shows the improvement in the approximation to the "camel" function by implementing the invention.

The advantage of the method according to the invention is illustrated hereafter in connection with FIGS. 2 and 3.

The highly non-linear analytical function which was studied comprises two parameters x and y in order to better visualize the results. It is the "camel" function, which is characterized by its high non-linearity. The expression of this function is as follows:

$$F(x, y) = 4x^4 - \frac{21}{10}x^4 + \frac{1}{3}x^6 + xy - 4y^2 + 4y^4$$

It is graphically represented in the unit cube $[-1,1]^2$ bearing reference A in FIG. 2.

Reference B in FIG. 2 is the graph of the estimation of the "camel" function by a linear model obtained from a 4-simulation factorial design. Reference C in FIG. 2 is the graph of the estimation of the "camel" function by a polynomial of the second order obtained from a 9-simulation centered composite design.

The disparity of the results between, on the one hand, the function to be modelled (cube A) and, on the other hand, the models (cubes B and C) confirms the limits of the theory of conventional experimental designs for modelling non-linear functions.

FIG. 3 illustrates the optimization, according to our invention, of the model approaching the "camel" function. The function represented in the unit cube $[-1,1]^2$ bearing reference D is obtained by carrying out steps 2 and 3 from a Latin hypercube of initial maximum distance containing nine tests. Then, the functions represented in the unit cube $[-1,1]^2$ bearing references E, F and G are obtained by adjusting this function obtained from a Latin hypercube and by adding seven simulation points. Stages 4 and 5 are repeated three times.

By comparing function G in FIG. 3 with the "camel" function A of FIG. 2, the curves are seen to be relatively close to one another with the non-linearities being clearly detected. The method according to the invention is suitable and the results are very satisfactory.

The invention claimed is:

1. A method of simulation of production of an oil reservoir using a computer, comprising:

a) providing a computer-based flow simulator utilizing physical data obtained from measurements of the oil reservoir;

b) operating the flow simulator of step a) to provide production values at points selected from the oil reservoir and providing a computer-based first model representing production of the reservoir as a function of time by adjustment of the production values provided by the flow simulator based upon simulated data without utilizing physical data obtained from measurements of the oil reservoir, the first model accounting for parameters which influence the production of the reservoir;

c) selecting at least one new production value associated with a point located within an area of the reservoir selected as a function of non-linearity of production in the selected area of the reservoir which is obtained from operating the flow simulator of step a); and d) providing a computer-based second model by adjusting the first model so that a response of the second model at the selected point within the selected area corresponds to the at least one new production value based upon simulated data without utilizing physical data obtained from measurements of the oil reservoir.

2. A method as claimed in claim 1 wherein, in step c), the following steps are carried out:

providing a sub-model that provides adjustment to the production values except for a test value selected from the production values;

calculating a prediction residue associated with the test value by determining a difference between a response of the sub-model and the test value selected from the production values;

calculating a prediction residue associated with each prediction value by repeating determining a sub-model and calculating a prediction residue by assigning successively to the test value each value contained within the production values; and selecting a new production value in an area of the reservoir in a vicinity of a point associated with a production value having a largest prediction residue.

3. A method as claimed in claim 2, wherein the selected new production value is selected by accounting for a production gradient at a point associated with a production value having a largest prediction residue.

4. A method as claimed in claim 2, wherein a new value is selected in step c) and step d) is carried out when largest prediction residue is larger than a previous production value.

5. A method as claimed in claim 1 wherein, in step c), the following steps are carried out:

determining a first kriging variance of the first model for production values obtained from the flow simulator;

selecting a first pilot point in the reservoir where the first kriging variance is a maximum;

determining a second kriging variance of the first model for the production values obtained by the flow simulator and the first pilot point;

selecting a second pilot point in the reservoir where the second kriging variance is a maximum; and assigning a value to each pilot point by carrying out the following five operations for each pilot point:

(1) providing a sub-model that provides an adjustment to production values and to a value associated with one of the pilot points, except for a test value selected from production values and a production value associated with the pilot point;

(2) calculating a prediction residue associated with the test value by determining a difference between a response of the sub-model and the test value selected from the production values;

(3) calculating a prediction residue associated with each response of the sub-model by repeating the determining a sub-model and calculating a prediction residue by assigning successively to the test value each value contained in a set of the production values and the value associated with the pilot point;

(4) calculating a sum of absolute values of prediction residues calculated for each test value; and (5) assigning to the pilot point a value that minimizes the sum, providing a second sub-model that provides an adjustment closest to the production values and to values of the pilot points, and for each pilot point determining a difference between a response of the second sub-model and a response of the first model and associating the new production value of step c) with a pilot point for which the difference between the response of the second sub-model and a response of the first model is largest.

6. A method as claimed in claim 5 wherein, in step d), the second model is provided by adjusting the first model so that a response of the second model at the selected pilot point corresponds to the new production value and to values assigned to other pilot points.

7. A method as claimed in claim 1 wherein, in step c), the following steps are carried out:

providing a model representing a derivative of reservoir production as a function of time by adjusting to the derivative at points associated with the production values used in step b); and from the model representing the derivative, selecting at least one new production value associated with a point whose response of the model expressing the derivative is zero.

8. A method as claimed in claim 7, wherein a new value is selected in step c) and step d) is carried out by selecting a prediction residue of the new value which is larger than a previously set value.

9. A method as claimed in claim 7 wherein, after step d), the following steps are carried out:

providing a third model expressing the derivative of the reservoir production as a function of time by adjusting to derivatives at the points associated with the production values and production values selected in step c);

if the response of the third model at a point selected in step c) is greater than zero, determining a point associated with a maximum value of the response of the second model in a vicinity of the point selected in step c);

if the response of the third model at the point selected in step c) is less than zero, determining a point associated with a minimum value of a response of the second model in a vicinity of the point selected in step c);

determining a new production value utilizing the flow simulator at a point associated with a previously determined minimum or maximum value; and providing a fourth model by adjusting the second model so that the response of the fourth model corresponds to a new value determined in the determining a new production value utilizing the flow simulator at a point associated with a previously determined minimum.

10. A method as claimed in claim 1 wherein steps c) and d) are repeated.

11. A method as claimed in claim 1 wherein, in step b), the production values are selected using an experimental design.

12. A method as claimed in claim 1 wherein, in step b), the first model is adjusted using one of the following approximation methods: polynomial approximation, neural networks or support vector machines.

13. A method as claimed in claim 1 wherein, in step d), one of the following interpolation methods is used: a kriging method or a spline method.

14. A method comprising:

a) providing a computer-based flow simulator utilizing physical data obtained from measurements of an oil reservoir;

b) operating the flow simulator of step a) to provide production values at points selected from the oil reservoir and providing a computer-based first model representing production of the reservoir as a function of time by adjustment of the production values provided by the flow simulator based upon simulated data without utilizing physical data obtained from measurements of the oil reservoir, the model accounting for parameters which influence the production of the reservoir;

c) selecting at least one new production value associated with a point located within an area of the reservoir selected as a function of non-linearity of production in the selected area of the reservoir which is obtained from operating the flow simulator of step a);

d) providing a computer-based second model by adjusting the first model so that a response of the second model at the selected point within the selected area corresponds to the at least one new production value based upon simulated data without utilizing physical data obtained from measurements of the oil reservoir; and e) using the second model to manage the reservoir or to provide production from the reservoir.

15. A method as claimed in claim 14 wherein, in step c), the following steps are carried out:

providing a sub-model that provides adjustment to the production values except for a test value selected from the production values;

calculating a prediction residue associated with the test value by determining a difference between a response of the sub-model and the test value selected from the production values;

calculating a prediction residue associated with each prediction value by repeating determining a sub-model and calculating a prediction residue by assigning successively to the test value each value contained within the production values; and selecting a new production value in an area of the reservoir in a vicinity of a point associated with a production value having a largest prediction residue.

16. A method as claimed in claim 15, wherein the selected new production value is selected by accounting for a production gradient at a point associated with a production value having a largest prediction residue.

17. A method as claimed in claim 15, wherein a new value is selected in step c) and step d) is carried out when largest prediction residue is larger than a previous production value.

18. A method as claimed in claim 14 wherein, in step c), the following steps are carried out:

determining a first kriging variance of the first model for production values obtained from the flow simulator;

selecting a first pilot point in the reservoir where the first kriging variance is a maximum;

determining a second kriging variance of the first model for the production values obtained by the flow simulator and the first pilot point;

selecting a second pilot point in the reservoir where the second kriging variance is a maximum; and assigning a value to each pilot point by carrying out the following five operations for each pilot point:

(1) providing a sub-model that provides an adjustment to production values and to a value associated with one of the pilot points, except for a test value selected from production values and a production value associated with the pilot point;

(2) calculating a prediction residue associated with the test value by determining a difference between a response of the sub-model and the test value selected from the production values;

(3) calculating a prediction residue associated with each response of the sub-model by repeating the determining a sub-model and calculating a prediction residue by assigning successively to the test value each value contained in a set of the production values and the value associated with the pilot point;

(4) calculating a sum of absolute values of prediction residues calculated for each test value; and (5) assigning to the pilot point a value that minimizes the sum, providing a second sub-model that provides an adjustment closest to the production values and to values of the pilot points and for each pilot point determining a difference between a response of the second sub-model and a response of the first model and associating the new production value of step c) with a pilot point for which the difference between the response of the second sub-model and a response of the first model is largest.

19. A method as claimed in claim 18 wherein, in step d), the second model is provided by adjusting the first model so that a response of the second model at the selected pilot point corresponds to the new production value and to values assigned to other pilot points.

20. A method as claimed in claim 14 wherein, in step c), the following steps are carried out:

providing a model representing a derivative of reservoir production as a function of time by adjusting to the derivative at points associated with the production values used in step b); and from the model representing the derivative, selecting at least one new production value associated with a point whose response of the model expressing the derivative is zero.

21. A method as claimed in claim 20, wherein a new value is selected in step c) and step d) is carried out by selecting a prediction residue of the new value which is larger than a previously set value.

22. A method as claimed in claim 20 wherein, after step d), the following steps are carried out:

providing a third model expressing the derivative of the reservoir production as a function of time by adjusting to derivatives at the points associated with the production values and production values selected in step c);

if the response of the third model at a point selected in step c) is greater than zero, determining a point associated with a maximum value of the response of the second model in a vicinity of the point selected in step c);

if the response of the third model at the point selected in step c) is less than zero, determining a point associated with a minimum value of a response of the second model in a vicinity of the point selected in step c);

determining a new production value utilizing the flow simulator at a point associated with a previously determined minimum or maximum value; and providing a fourth model by adjusting the second model so that the response of the fourth model corresponds to a new value determined in the determining a new production value utilizing the flow simulator at a point associated with a previously determined minimum.

23. A method as claimed in claim 14 wherein steps c) and d) are repeated.

24. A method as claimed in claim 14 wherein, in step b), the production values are selected using an experimental design.

25. A method as claimed in claim 14 wherein, in step b), the first model is adjusted using one of the following approximation methods: polynomial approximation, neural networks or support vector machines.

26. A method as claimed in claim 14 wherein, in step d), one of the following interpolation methods is used: a kriging method or a spline method.

27. A method as claimed in claim 14 wherein the use of the second model is to manage the reservoir.

28. A method as claimed in claim 14 wherein the use of the second model is to provide production from the reservoir.

* * * * *